US010209030B2

(12) United States Patent
Moore et al.

(10) Patent No.: US 10,209,030 B2
(45) Date of Patent: Feb. 19, 2019

(54) GUN GRIP

(71) Applicants: Larry E. Moore, Cottonwood, AZ (US); Aaron Moore, Cottonwood, AZ (US)

(72) Inventors: Larry E. Moore, Cottonwood, AZ (US); Aaron Moore, Cottonwood, AZ (US)

( * ) Notice: Subject to any disclaimer, the term of this patent is extended or adjusted under 35 U.S.C. 154(b) by 0 days.

(21) Appl. No.: 15/253,543

(22) Filed: Aug. 31, 2016

(65) Prior Publication Data

US 2018/0058804 A1 Mar. 1, 2018

(51) Int. Cl.
*F41G 1/35* (2006.01)
*F41C 23/10* (2006.01)

(52) U.S. Cl.
CPC ..... *F41C 23/10* (2013.01); *F41G 1/35* (2013.01)

(58) Field of Classification Search
CPC ..... F41C 23/10; F41C 23/16; F41C 23/18; F41G 1/35
USPC ..... D22/102, 103, 108, 104
See application file for complete search history.

(56) References Cited

U.S. PATENT DOCUMENTS

| | | | | |
|---|---|---|---|---|
| 1,490,272 A | | 4/1924 | Hickam | |
| 1,898,566 A | | 2/1933 | Noel | |
| 2,268,056 A | | 12/1941 | Nelson et al. | |
| 2,308,627 A | * | 1/1943 | Rickenbacher | F41C 23/10 42/71.02 |
| 2,357,951 A | | 9/1944 | Hale | |
| 2,430,469 A | | 11/1947 | Karnes | |
| 2,597,565 A | | 5/1952 | Chandler et al. | |
| 2,701,930 A | * | 2/1955 | Dolan | F41C 23/00 144/136.2 |
| 2,773,309 A | | 12/1956 | Elliot | |
| 2,780,882 A | | 2/1957 | Temple | |
| 2,826,848 A | | 3/1958 | Davies | |
| 2,844,710 A | | 7/1958 | Rudolf | |
| 2,894,117 A | | 7/1959 | Koskey | |
| 2,904,888 A | | 9/1959 | Niesp | |
| 2,926,916 A | | 3/1960 | Pearson | |
| 3,104,478 A | | 9/1963 | Strauss | |
| 3,112,567 A | | 12/1963 | Flanagan | |
| 3,192,915 A | | 7/1965 | Norris et al. | |
| 3,284,905 A | | 11/1966 | Simmons | |

(Continued)

FOREIGN PATENT DOCUMENTS

| | | |
|---|---|---|
| BE | 1009564 | 5/1997 |
| EP | 1046877 | 10/2000 |
| FR | 862247 | 3/1941 |

OTHER PUBLICATIONS

Ducet, Denny, "Arsenal Strike One Review", http://dennyducet.blogspot.com/2015/06/the-arsenal-strike-one-innovative.html, Jun. 18, 2015 (Year: 2015).*

(Continued)

*Primary Examiner* — Joshua T Semick
(74) *Attorney, Agent, or Firm* — Snell & Wilmer L.L.P.

(57) ABSTRACT

A grip for use on a firearm includes a base surface, portions that are raised above the base surface, and/or portions that are lower than the base surface. The grip may include raised portions and lowered portions that alternate vertically and/or horizontally on the grip. The raised portions may be 0.005" to 0.050" above the surface, and the lowered portions may be 0.005" to 0.050" lower than the surface. The grip may be formed of any suitable material, such as plastic or rubber, and made in any suitable manner, such as injection molding or vacuum molding. The raised portions and/or lowered portions may include one or more of designs, letters, and numbers.

36 Claims, 15 Drawing Sheets

(56) References Cited

U.S. PATENT DOCUMENTS 3,510,965 A 5/1970 Rhea
3,526,972 A 9/1970 Sumpf
3,573,868 A 4/1971 Giannetti
3,618,673 A * 11/1971 Gossett ..... A01B 1/24 111/92
3,633,285 A 1/1972 Sensney
3,641,676 A 2/1972 Knutsen et al.
3,645,635 A 2/1972 Steck
3,748,751 A 7/1973 Breglia
3,801,205 A 4/1974 Eggenschwyler
3,813,795 A 6/1974 Marshall
3,914,873 A 10/1975 Elliot, Jr. et al.
3,948,522 A 4/1976 Fixler
3,992,783 A 11/1976 Dunlap et al.
3,995,376 A 12/1976 Kimble et al.
4,026,054 A 5/1977 Snyder
4,048,489 A 9/1977 Giannetti
4,063,368 A 12/1977 McFarland
4,079,534 A 3/1978 Snyder
4,102,059 A 7/1978 Kimble et al.
4,144,505 A 3/1979 Angelbeck et al.
4,146,329 A 3/1979 King et al.
4,148,245 A 4/1979 Steffanus et al.
4,156,981 A 6/1979 Lusk
4,168,588 A 9/1979 Snyder
4,220,983 A 9/1980 Schroeder
4,222,564 A 9/1980 Allen
4,229,103 A 10/1980 Hipp
4,232,867 A 11/1980 Tate
4,233,770 A 11/1980 de Filippis et al.
4,234,911 A 11/1980 Faith
4,295,289 A 10/1981 Snyder
4,305,091 A 12/1981 Cooper
4,346,530 A * 8/1982 Stewart ..... F41C 23/18 42/71.01
4,348,828 A 9/1982 Snyder
4,352,665 A 10/1982 Kimble et al.
4,452,458 A 6/1984 Timander
4,481,561 A 11/1984 Lanning
4,487,583 A 12/1984 Brucker
4,488,369 A 12/1984 Van Note
4,541,191 A 9/1985 Morris et al.
4,567,810 A 2/1986 Preston
4,662,845 A 5/1987 Gallaher
4,713,889 A 12/1987 Santiago
4,763,431 A 8/1988 Allan et al.
4,825,258 A 4/1989 Whitson
4,830,617 A 5/1989 Hancox et al.
4,860,775 A * 8/1989 Reeves ..... A45D 20/48 132/118
4,876,816 A 10/1989 Triplett
4,878,307 A 11/1989 Singletary
4,891,476 A 1/1990 Nation et al.
4,934,086 A 6/1990 Houde-Walter
4,939,320 A 7/1990 Graulty
4,939,863 A 7/1990 Alexander et al.
4,945,667 A 8/1990 Rogalski et al.
4,953,316 A 9/1990 Litton et al.
4,967,642 A 11/1990 Mihaita
5,001,836 A 3/1991 Cameron et al.
5,004,423 A 4/1991 Bertrams
5,033,219 A 7/1991 Johnson et al.
5,048,211 A 9/1991 Hepp
5,048,215 A 9/1991 Davis
5,052,138 A 10/1991 Crain
5,090,805 A 2/1992 Stawarz
5,092,071 A 3/1992 Moore
5,119,576 A 6/1992 Erning
5,177,309 A 1/1993 Willoughby et al.
5,178,265 A 1/1993 Sepke
5,179,235 A 1/1993 Toole
5,194,007 A 3/1993 Marshall
5,197,796 A 3/1993 Moore
5,208,826 A 5/1993 Kelly
5,179,124 A 6/1993 Schoenwald et al.
5,228,427 A 7/1993 Gardner
5,237,773 A 8/1993 Claridge
5,241,146 A 8/1993 Priesemuth
5,272,514 A 12/1993 Dor
5,299,375 A 4/1994 Thummel et al.
5,343,376 A 8/1994 Huang
5,353,208 A 10/1994 Moore
5,355,608 A 10/1994 Teetzel
5,355,609 A 10/1994 Schenke
5,365,669 A 11/1994 Rustick et al.
5,367,779 A 11/1994 Lee
5,373,644 A 12/1994 De Paoli
5,375,362 A 12/1994 McGarry et al.
5,388,335 A 2/1995 Jung
5,392,550 A 2/1995 Moore et al.
5,400,540 A 3/1995 Solinsky et al.
5,419,072 A 5/1995 Moore et al.
5,432,598 A 7/1995 Szatkowski
5,435,091 A 7/1995 Toole et al.
5,446,535 A 8/1995 Williams
5,448,834 A 9/1995 Huang
5,454,168 A 10/1995 Langner
5,455,397 A 10/1995 Havenhill et al.
5,467,552 A 11/1995 Cupp et al.
5,488,795 A 2/1996 Sweat
D368,121 S 3/1996 Lam
5,509,226 A 4/1996 Houde-Walter
5,499,455 A 5/1996 Palmer
5,515,636 A 5/1996 McGarry et al.
5,481,819 A 6/1996 Teetzel
5,531,040 A 7/1996 Moore
5,555,662 A 9/1996 Teetzel
5,557,872 A 9/1996 Langner
5,566,459 A 10/1996 Breda
5,581,898 A 12/1996 Thummel
5,584,137 A 12/1996 Teetzel
5,590,486 A 1/1997 Moore
5,598,958 A 2/1997 Ryan, III et al.
5,605,461 A 2/1997 Seeton
5,618,099 A 4/1997 Brubacher
5,621,999 A 4/1997 Moore
5,622,000 A 4/1997 Marlowe
5,654,594 A 8/1997 Bjornsen, III
5,669,174 A 9/1997 Teetzel
5,671,561 A 9/1997 Johnson et al.
5,685,106 A 11/1997 Shoham
5,685,636 A 11/1997 German
5,694,202 A 12/1997 Mladjan et al.
5,694,713 A 12/1997 Paldino
5,704,153 A 1/1998 Kaminski et al.
5,706,600 A 1/1998 Toole et al.
5,716,216 A 2/1998 O'Loughlin
5,735,070 A 4/1998 Vasquez et al.
5,787,631 A 8/1998 Kendall
5,788,500 A 8/1998 Gelber
5,822,905 A 10/1998 Teetzel
5,842,300 A 12/1998 Cheshelski et al.
5,842,942 A 12/1998 Doht et al.
5,847,345 A 12/1998 Harrison
5,867,930 A 2/1999 Kaminski et al.
5,881,707 A 3/1999 Gardner
5,892,221 A 4/1999 Lev
5,896,691 A 4/1999 Kaminski et al.
5,905,238 A 5/1999 Hung
5,909,951 A 6/1999 Johnsen et al.
5,922,030 A 7/1999 Shank et al.
5,967,133 A 10/1999 Gardner
5,983,774 A 11/1999 Mihaita
6,003,504 A 12/1999 Rice et al.
6,023,875 A 2/2000 Fell et al.
6,035,843 A 3/2000 Smith et al.
6,146,141 A 11/2000 Schumann
6,151,788 A 11/2000 Cox et al.
6,219,952 B1 4/2001 Mossberg et al.
6,230,431 B1 5/2001 Bear
6,237,271 B1 5/2001 Kaminski
6,282,829 B1 9/2001 Mossberg et al.
6,289,624 B1 9/2001 Hughes et al.
6,293,869 B1 9/2001 Kwan

(56) References Cited

U.S. PATENT DOCUMENTS 6,295,753 B1 10/2001 Thummel
6,301,046 B1 10/2001 Tai et al.
6,318,228 B1 11/2001 Thompson
6,327,806 B1 12/2001 Paige
6,363,648 B1 4/2002 Kranich et al.
6,366,349 B1 4/2002 Houde-Walter
6,371,004 B1 4/2002 Peterson
6,378,237 B1 4/2002 Matthews et al.
6,385,893 B1 5/2002 Cheng
6,389,729 B2 5/2002 Rauch et al.
6,389,730 B1 5/2002 Millard
6,397,509 B1 6/2002 Langner
6,421,947 B1 7/2002 Fuller
6,430,861 B1 8/2002 Ayers et al.
6,434,874 B1 8/2002 Hines
6,442,880 B1 9/2002 Allan
6,345,464 B1 12/2002 Kim et al.
6,487,807 B1 12/2002 Kopman et al.
6,499,247 B1 12/2002 Peterson
6,526,688 B1 3/2003 Danielson et al.
6,568,118 B1 5/2003 Teetzel
6,571,503 B2 6/2003 Thorpe
6,572,375 B2 6/2003 Shechter et al.
6,575,753 B2 6/2003 Rosa et al.
6,578,311 B2 6/2003 Danielson et al.
6,579,098 B2 6/2003 Shechter et al.
6,591,536 B2 7/2003 Houde-Walter et al.
6,606,797 B1 8/2003 Gandy
6,614,510 B1 9/2003 Rogers et al.
6,616,452 B2 9/2003 Clark et al.
6,622,414 B1 9/2003 Oliver et al.
6,631,580 B2 10/2003 Iafrate
6,631,668 B1 10/2003 Wilson et al.
6,650,669 B1 11/2003 Adkins
6,671,991 B1 1/2004 Danielson
6,682,350 B2 1/2004 Kehl
D487,791 S 3/2004 Freed
6,742,299 B2 6/2004 Strand
6,749,075 B2 * 6/2004 Bourque ..... B65D 1/0223 215/365
6,782,789 B2 8/2004 McNulty
6,804,907 B1 * 10/2004 Slobodkin ..... F41C 23/10 42/71.01
6,843,478 B1 1/2005 Hoepelman
6,854,205 B2 2/2005 Wikle et al.
6,860,053 B2 * 3/2005 Christiansen ..... F41C 23/10 42/7
6,931,775 B2 8/2005 Burnett
6,935,864 B2 8/2005 Shechter et al.
6,945,782 B2 9/2005 Isoz
6,966,775 B1 11/2005 Kendir et al.
7,032,342 B2 4/2006 Pikielny
7,049,575 B2 5/2006 Hotelling
7,111,424 B1 9/2006 Moody et al.
7,117,624 B2 10/2006 Kim
7,121,034 B2 10/2006 Keng
7,134,234 B1 11/2006 Makarounis
7,191,557 B2 3/2007 Gablowski et al.
D542,446 S 5/2007 Dicarlo et al.
7,218,501 B2 5/2007 Keely
7,237,352 B2 7/2007 Keely et al.
7,243,454 B1 7/2007 Cahill
7,260,910 B2 8/2007 Danielson
7,264,369 B1 9/2007 Howe
7,303,306 B2 12/2007 Ross et al.
7,305,790 B2 12/2007 Kay
7,325,352 B2 2/2008 Matthews et al.
7,329,127 B2 2/2008 Kendir et al.
7,331,137 B2 2/2008 Hsu
D567,894 S 4/2008 Sterling et al.
7,360,333 B2 4/2008 Kim
D570,948 S 6/2008 Cerovic et al.
7,387,052 B2 * 6/2008 Chang ..... B25B 13/04 81/119
RE40,429 E 7/2008 Oliver et al.
7,409,770 B2 8/2008 Jones
D578,599 S 10/2008 Cheng
7,438,430 B2 10/2008 Kim
7,441,364 B2 10/2008 Rogers et al.
7,453,918 B2 11/2008 Laughman et al.
7,454,858 B2 11/2008 Griffin
7,464,495 B2 12/2008 Cahill
7,472,830 B2 1/2009 Danielson
D586,874 S 2/2009 Moody et al.
7,490,429 B2 2/2009 Moody et al.
7,505,119 B2 3/2009 Rogers et al.
7,578,089 B1 8/2009 Griffin
7,584,569 B2 9/2009 Kallio
7,591,098 B2 9/2009 Matthews et al.
D602,109 S 10/2009 Cerovic et al.
7,603,997 B2 10/2009 Hensel et al.
D603,478 S 11/2009 Hughes
7,624,528 B1 12/2009 Bell et al.
7,627,976 B1 12/2009 Olson
7,644,530 B2 1/2010 Scherpf
7,652,216 B2 1/2010 Sharrah et al.
D612,756 S 3/2010 D'Amelio et al.
D612,757 S 3/2010 D'Amelio et al.
7,674,003 B2 3/2010 Sharrah et al.
7,676,975 B2 3/2010 Phillips et al.
7,685,756 B2 3/2010 Moody et al.
7,698,847 B2 4/2010 Griffin
7,703,719 B1 4/2010 Bell et al.
7,712,241 B2 5/2010 Teetzel et al.
D616,957 S 6/2010 Rievley et al.
7,726,059 B2 6/2010 Pikielny
7,726,061 B1 6/2010 Thummel
7,730,820 B2 6/2010 Vice et al.
7,743,546 B2 6/2010 Keng
7,743,547 B2 6/2010 Houde-Walter
7,753,549 B2 7/2010 Solinsky et al.
7,771,077 B2 8/2010 Miller
7,797,843 B1 9/2010 Scott et al.
7,805,876 B1 10/2010 Danielson et al.
7,818,910 B2 10/2010 Young
7,827,726 B2 11/2010 Stokes
7,841,120 B2 11/2010 Teetzel et al.
7,880,100 B2 2/2011 Sharrah et al.
7,900,390 B2 3/2011 Moody et al.
7,913,439 B2 3/2011 Whaley
D636,049 S 4/2011 Hughes et al.
D636,837 S 4/2011 Hughes et al.
7,921,591 B1 4/2011 Adcock
7,926,218 B2 4/2011 Matthews et al.
7,997,023 B2 8/2011 Moore et al.
8,001,715 B2 8/2011 Stokes
8,006,427 B2 8/2011 Blevins et al.
8,006,428 B2 8/2011 Moore et al.
8,028,460 B2 10/2011 Williams
8,028,461 B2 10/2011 NuDyke
8,050,307 B2 11/2011 Day et al.
8,056,277 B2 11/2011 Griffin
8,093,992 B2 1/2012 Jancie et al.
8,100,694 B2 1/2012 Portoghese
8,104,220 B2 1/2012 Cobb
D653,798 S 2/2012 Janice et al.
8,109,024 B2 2/2012 Abst
8,110,760 B2 2/2012 Sharrah et al.
8,127,485 B2 3/2012 Moore
8,132,352 B2 3/2012 Lippard
8,132,354 B1 3/2012 Sellers et al.
8,136,284 B2 3/2012 Moody et al.
8,141,288 B2 3/2012 Dodd et al.
8,146,282 B2 4/2012 Cabahug et al.
8,147,304 B2 4/2012 Yamada
8,151,504 B1 4/2012 Aiston
8,151,505 B2 4/2012 Thompson
8,166,694 B2 5/2012 Swan
8,172,139 B1 5/2012 McDonald et al.
8,182,109 B2 5/2012 Matthews et al.
D661,366 S 6/2012 Zusman
8,196,328 B2 6/2012 Simpkins
8,215,047 B2 7/2012 Ash et al.
8,225,542 B2 7/2012 Houde-Walter

(56) References Cited

U.S. PATENT DOCUMENTS 8,225,543 B2 7/2012 Moody et al.
8,245,428 B2 8/2012 Griffin
8,245,434 B2 8/2012 Hogg et al.
8,256,154 B2 9/2012 Danielson et al.
8,258,416 B2 9/2012 Sharrah et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
D670,785 S 11/2012 Fitzpatrick et al.
8,312,666 B2 11/2012 Moore et al.
D672,005 S 12/2012 Hedeen et al.
8,322,064 B2 12/2012 Cabahug et al.
8,335,413 B2 12/2012 Dromaretsky et al.
D674,861 S 1/2013 Johnston et al.
D674,862 S 1/2013 Johnston et al.
D675,281 S 1/2013 Speroni
8,341,868 B2 1/2013 Zusman
8,347,541 B1 1/2013 Thompson
8,356,543 B2 1/2013 Rosol et al.
8,356,818 B2 1/2013 Mraz
8,360,598 B2 1/2013 Sharrah et al.
D676,097 S 2/2013 Izumi
8,365,456 B1 2/2013 Shepard
D677,433 S 3/2013 Swan et al.
D678,976 S 3/2013 Pittman
8,387,294 B2 3/2013 Bolden
8,393,104 B1 3/2013 Moody et al.
8,393,105 B1 3/2013 Thummel
8,397,418 B2 3/2013 Cabahug et al.
8,402,683 B2 3/2013 Cabahug et al.
8,413,362 B2 4/2013 Houde-Walter
D682,977 S 5/2013 Thummel et al.
8,443,539 B2 5/2013 Cabahug et al.
8,444,291 B2 5/2013 Swan et al.
8,448,368 B2 5/2013 Cabahug et al.
8,458,944 B2 6/2013 Houde-Walter
8,464,451 B2 6/2013 McRae
8,467,430 B2 6/2013 Caffey et al.
8,468,734 B2 6/2013 Meller et al.
8,468,930 B1 6/2013 Bell
D687,120 S 7/2013 Hughes et al.
8,480,329 B2 7/2013 Fluhr et al.
8,484,880 B1 7/2013 Sellers et al.
8,484,882 B2 7/2013 Haley et al.
8,485,686 B2 7/2013 Swan et al.
8,510,981 B1 8/2013 Ganther et al.
8,516,731 B2 8/2013 Cabahug et al.
8,567,981 B2 10/2013 Finnegan et al.
8,584,587 B2 11/2013 Uhr
8,607,495 B2 12/2013 Moore et al.
D697,162 S 1/2014 Faifer
D697,163 S * 1/2014 Bietsch ..... D22/108
8,646,201 B2 2/2014 Hughes
8,661,725 B1 3/2014 Ganther et al.
8,662,694 B1 3/2014 Izumi et al.
8,734,156 B2 5/2014 Uhr
8,739,447 B2 6/2014 Merritt et al.
D709,585 S * 7/2014 Klecker ..... D22/108
D710,966 S * 8/2014 Barfoot ..... D22/108
8,807,779 B1 8/2014 Izumi et al.
8,813,411 B2 8/2014 Moore et al.
8,844,189 B2 9/2014 Moore et al.
D720,423 S * 12/2014 Barfoot ..... D22/108
8,915,009 B2 12/2014 Caulk
8,919,023 B2 12/2014 Merritt et al.
8,927,083 B2 * 1/2015 Pell ..... B25G 1/10
16/110.1
8,938,904 B1 1/2015 Sellers et al.
D722,125 S * 2/2015 Zayatz ..... D22/108
8,944,626 B2 2/2015 Matthews et al.
8,944,838 B2 2/2015 Mulfmger
8,991,093 B1 3/2015 Calvert
9,011,279 B2 * 4/2015 Johnson ..... F42B 6/003
473/568
9,023,459 B2 * 5/2015 Hogue ..... B32B 5/12
428/174
9,146,077 B2 9/2015 Moore
9,182,194 B2 11/2015 Moore
9,188,407 B2 11/2015 Moore
9,243,865 B1 1/2016 Bruhns
9,272,402 B2 * 3/2016 Hu ..... B25B 23/16
9,297,614 B2 3/2016 Moore
9,453,702 B2 9/2016 Bruhns
9,644,826 B2 5/2017 Moore
9,658,031 B1 5/2017 Hedeen
9,772,163 B2 9/2017 Sharrah et al.
9,777,984 B1 * 10/2017 Bonine ..... F41C 23/10
9,791,240 B2 10/2017 Bruhns
D802,704 S 11/2017 Planck
9,810,411 B2 11/2017 Galli
9,829,280 B1 11/2017 Moore et al.
9,841,254 B2 12/2017 Moore
9,915,508 B2 3/2018 Moore et al.
9,982,963 B2 * 5/2018 Johnson ..... A63B 69/38
10,113,836 B2 10/2018 Moore et al.
2001/0042335 A1 11/2001 Strand
2002/0009694 A1 1/2002 Rosa
2002/0051953 A1 5/2002 Clark et al.
2002/0057719 A1 5/2002 Shechter
2002/0073561 A1 6/2002 Liao
2002/0104249 A1 8/2002 Lin
2002/0129536 A1 9/2002 Iafrate et al.
2002/0134000 A1 9/2002 Varshneya et al.
2002/0148153 A1 10/2002 Thorpe
2002/0194767 A1 12/2002 Houde-Walter et al.
2003/0003424 A1 1/2003 Shechter et al.
2003/0022135 A1 1/2003 Shechter et al.
2003/0029072 A1 3/2003 Danielson
2003/0084601 A1 5/2003 Kunimoto
2003/0175661 A1 9/2003 Shechter et al.
2003/0180692 A1 9/2003 Skala et al.
2003/0196366 A1 10/2003 Beretta
2004/0003529 A1 1/2004 Danielson
2004/0010956 A1 1/2004 Bubits
2004/0014010 A1 1/2004 Swensen et al.
2004/0064994 A1 * 4/2004 Luke ..... F41C 23/16
42/85
2005/0044736 A1 3/2005 Liao
2005/0130739 A1 6/2005 Argentar
2005/0153262 A1 7/2005 Kendir
2005/0185403 A1 8/2005 Diehl
2005/0188588 A1 9/2005 Keng
2005/0241209 A1 11/2005 Staley
2005/0257415 A1 11/2005 Solinsky et al.
2005/0268519 A1 12/2005 Pikielny
2006/0162225 A1 7/2006 Danielson
2006/0191183 A1 8/2006 Griffin
2007/0039226 A1 2/2007 Stokes
2007/0041418 A1 2/2007 Laughman et al.
2007/0056203 A1 3/2007 Gering et al.
2007/0113460 A1 5/2007 Potterfield et al.
2007/0190495 A1 8/2007 Kendir et al.
2007/0258236 A1 11/2007 Miller
2007/0271832 A1 11/2007 Griffin
2008/0000133 A1 1/2008 Solinsky et al.
2008/0060248 A1 3/2008 Pine et al.
2008/0134562 A1 6/2008 Teetzel
2009/0013580 A1 1/2009 Houde-Walter
2009/0013581 A1 1/2009 LoRocco
2009/0053679 A1 2/2009 Jones
2009/0178325 A1 7/2009 Veilleux
2009/0183416 A1 7/2009 Danielson
2009/0293335 A1 12/2009 Danielson
2009/0293855 A1 12/2009 Danielson
2009/0323733 A1 12/2009 Charkas
2010/0058640 A1 3/2010 Moore et al.
2010/0162610 A1 7/2010 Moore et al.
2010/0175297 A1 7/2010 Speroni
2010/0227298 A1 9/2010 Charles
2010/0229448 A1 9/2010 Houde-Walter

(56) References Cited

U.S. PATENT DOCUMENTS

| | | | | |
|---|---|---|---|---|
| 2010/0263254 | A1* | 10/2010 | Glock | F41A 11/02 42/71.02 |
| 2010/0275496 | A1 | 11/2010 | Solinsky et al. | |
| 2011/0047850 | A1 | 3/2011 | Rievley et al. | |
| 2011/0061283 | A1 | 3/2011 | Cavallo | |
| 2011/0074303 | A1 | 3/2011 | Stokes | |
| 2011/0119868 | A1* | 5/2011 | LaLonde | B25G 1/102 16/421 |
| 2011/0154712 | A1 | 6/2011 | Moore | |
| 2011/0162249 | A1 | 7/2011 | Woodmansee et al. | |
| 2011/0162251 | A1 | 7/2011 | Houde-Walter | |
| 2011/0185619 | A1 | 8/2011 | Finnegan et al. | |
| 2011/0225867 | A1 | 9/2011 | Moore | |
| 2012/0005938 | A1 | 1/2012 | Sloan | |
| 2012/0047787 | A1 | 3/2012 | Curry | |
| 2012/0055061 | A1 | 3/2012 | Hartley et al. | |
| 2012/0110886 | A1 | 5/2012 | Moore et al. | |
| 2012/0124885 | A1 | 5/2012 | Caulk et al. | |
| 2012/0129136 | A1 | 5/2012 | Dvorak | |
| 2012/0144716 | A1 | 6/2012 | Cabahug et al. | |
| 2012/0144718 | A1 | 6/2012 | Danielson | |
| 2012/0180366 | A1 | 7/2012 | Jaroh et al. | |
| 2012/0180367 | A1 | 7/2012 | Singh | |
| 2012/0180370 | A1 | 7/2012 | McKinley | |
| 2012/0224357 | A1 | 9/2012 | Moore | |
| 2012/0224387 | A1 | 9/2012 | Moore | |
| 2012/0268920 | A1 | 10/2012 | Matthews | |
| 2013/0185978 | A1 | 7/2013 | Dodd et al. | |
| 2013/0185982 | A1 | 7/2013 | Hilbourne et al. | |
| 2013/0205635 | A1* | 8/2013 | Hines | F41C 23/16 42/71.02 |
| 2013/0263492 | A1 | 10/2013 | Erdle | |
| 2013/0318851 | A1* | 12/2013 | Diamond | F41C 27/00 42/90 |
| 2014/0007485 | A1 | 1/2014 | Castejon | |
| 2014/0109457 | A1 | 4/2014 | Speroni | |
| 2014/0157645 | A1 | 6/2014 | Moore | |
| 2014/0176463 | A1 | 6/2014 | Donahoe | |
| 2014/0256481 | A1 | 9/2014 | Flint | |
| 2014/0355258 | A1 | 12/2014 | Izumi et al. | |
| 2015/0192391 | A1 | 7/2015 | Moore | |
| 2015/0226508 | A1 | 8/2015 | Hughes | |
| 2015/0233668 | A1 | 8/2015 | Moore | |
| 2015/0283459 | A1 | 10/2015 | Condon | |
| 2015/0308670 | A1 | 10/2015 | Moore | |
| 2015/0345905 | A1 | 12/2015 | Hancosky | |
| 2015/0348330 | A1 | 12/2015 | Balachandreswaran | |
| 2016/0059136 | A1 | 3/2016 | Ferris | |
| 2016/0084618 | A1 | 3/2016 | Hong | |
| 2016/0091285 | A1 | 3/2016 | Mason | |
| 2016/0161220 | A1 | 6/2016 | Moore | |
| 2016/0169608 | A1 | 6/2016 | Schulz | |
| 2016/0195366 | A1 | 7/2016 | Kowalczyk et al. | |
| 2016/0209170 | A1 | 7/2016 | Mock et al. | |
| 2016/0209174 | A1 | 7/2016 | Hartley et al. | |
| 2016/0245617 | A1 | 8/2016 | Moore | |
| 2016/0305748 | A1 | 10/2016 | Moore | |
| 2016/0361626 | A1 | 12/2016 | Moore | |
| 2017/0003103 | A1 | 1/2017 | Moore | |
| 2017/0030677 | A1* | 2/2017 | Faifer | F41A 9/59 |
| 2017/0082399 | A1 | 3/2017 | Moore | |
| 2017/0153095 | A1 | 6/2017 | Moore | |
| 2017/0160054 | A1 | 6/2017 | Moore | |
| 2017/0205182 | A1 | 7/2017 | Hughes et al. | |
| 2018/0023923 | A1 | 1/2018 | Uhr | |
| 2018/0135944 | A1 | 5/2018 | Moore | |
| 2018/0149443 | A1 | 5/2018 | Dottie | |

OTHER PUBLICATIONS

Webpage print out from http://airgunexpress.com/Accessories/ referencing various level devices.

Webpage print out from http://secure.amorholdings.com/b-square/smarthtml/about.html referencing background on B-Square and their firearm accessories.

Webpage print out from http://secure.armorholdings.com/b-square/tools_scope.html referencing scope and site tools offered by B-Square.

Webpage print out from www.battenfeldtechnologies.com/113088.html referencing a level device.

Webpage print out from www.battenfeldtechnologies.com/wheeler referencing products from Wheeler Engineering.

Webpage print out from www.blackanddecker.com/laserline/lasers.aspx referencing Black & Decker's Auto-Leveling Lasers.

Webpage print out from www.laserlevel.co.uk/newsite.index.asp referencing the laser devices available on the Laserlevel Online Store.

Shooting Illustrated "Update on the .25 SAUM" Jul. 2005 pp. 14-15.

USPTO; Supplemental Notice of Allowance dated Sep. 13, 2017 in U.S. Appl. No. 15/166,145.

USPTO; Final Office Action dated Sep. 28, 2017 in U.S. Appl. No. 15/243,813.

USPTO; Notice of Allowance dated Oct. 27, 2017 in U.S. Appl. No. 14/955,440.

USPTO; Notice of Allowance dated Nov. 13, 2017 in U.S. Appl. No. 14/955,440.

UPSTO; Notice of Allowance and Fees Due dated Jul. 11, 2017 in U.S. Appl. No. 15/130,744.

USPTO; Notice of Allowance and Fees Due dated Jul. 31, 2017 in U.S. Appl. No. 15/166,145.

USPTO; Non-Final Office Action dated Dec. 7, 2017 in U.S. Appl. No. 15/075,769.

USPTO; Non-Final Office Action dated Dec. 18, 2017 in U.S. Appl. No. 15/787,134.

USPTO; Final Office Action dated Jan. 16, 2018 in U.S. Appl. No. 14/963,475.

USPTO; Non-Final Office Action dated Feb. 8, 2018 in U.S. Appl. No. 14/863,304.

USPTO; Non-Final Office Action dated Feb. 26, 2018 in U.S. Appl. No. 15/804,229.

USPTO; Advisory Action dated May 15, 2018 in U.S. Appl. No. 14/963,475.

USPTO; Requirement for Restriction dated Jun. 11, 2018 in U.S. Appl. No. 15/181,279.

USPTO; Final Office Action dated Aug. 31, 2018 in U.S. Appl. No. 15/804,229.

USPTO; Notice of Allowance dated Aug. 31, 2018 in U.S. Appl. No. 15/075,769.

USPTO; Non-Final Office Action dated Sep. 19, 2018 in U.S. Appl. No. 15/243,813.

USPTO; Notice of Allowance dated Oct. 3, 2018 in U.S. Appl. No. 15/884,122.

USPTO; Notice of Allowance dated Jun. 20, 2018 in U.S. Appl. No. 15/787,134.

USPTO; Non-Final Office Action dated Jun. 29, 2018 in U.S. Appl. No. 15/600,571.

USPTO; Non-Final Office Action dated Jul. 3, 2018 in U.S. Appl. No. 14/963,475.

USPTO; Notice of Allowance dated Jul. 18, 2018 in U.S. Appl. No. 15/075,769.

Google Search for crossbow laser, image search conducted on Nov. 29, 2017, 14 pages.

Google Search for crossbow laser, image search conducted on Nov. 29, 2017, 2 pages.

CrossbowNation-Community-Gear Review, Crossbow Laser Boresighter Bolt Video Review, 1 pages, printed on Nov. 29, 2017, dated Apr. 18, 2010.

CrossbowNation, Gear Review, Crossbow Laser Boresighter Bolt Video Review, 6 images taken therefrom, 6 pages, printed on Nov. 29, 2017, dated Apr. 18, 2010.

* cited by examiner

GUN GRIP

FIELD OF THE INVENTION

The present invention relates to an improved grip for a firearm.

BACKGROUND OF THE INVENTION

Hand grips for firearms, such as handguns, machine pistols and rifles, are known. Such hand grips are often formed of materials that are easy to grip, some of which are compressible, to allow the user to better grasp the grip. Handgun grips are often provided in multiple (usually two) pieces that are fit on each side of the gun handle and are secured by one or more fasteners. Similar grips may be utilized on rifles or other types of firearms.

Grip panels have been provided in different widths and thicknesses to accommodate the different sized-hands of different users.

Interchangeable gun grips are also known. They are typically bolted onto side panels of the gun handle. Handgrips can also be modified to accept a removable ergonomic insert that changes the palm relief of the firearm. In that case, several inserts with different profiles are provided to a user to select the most comfortable and/or appropriate size for the user.

SUMMARY OF THE INVENTION

A grip for use on a firearm includes a base surface, portions that are raised above the base surface (referred to as "raised portions"), or portions that are lower than the base surface (referred to as "lowered portions"), or portions that are raised above the base surface and portions that are lower than the base surface. If both raised portions and lowered portions are utilized, they may alternate along the grip, such as along the height of the grip, and each portion may include one or more of vertical and/or horizontal angled, or curved components. The raised portions may be 0.005" to 0.030" above the base surface, and the lowered portions may be 0.005" to 0.030" lower than the base surface. The grip may be formed of any suitable material, such as plastic or rubber, and made in any suitable manner, such as injection molding or vacuum molding. The portions or lowered portions may include one or more designs, letters, numbers, or any configuration thereof.

DETAILED DESCRIPTION OF PREFERRED EMBODIMENTS

Figure 1:
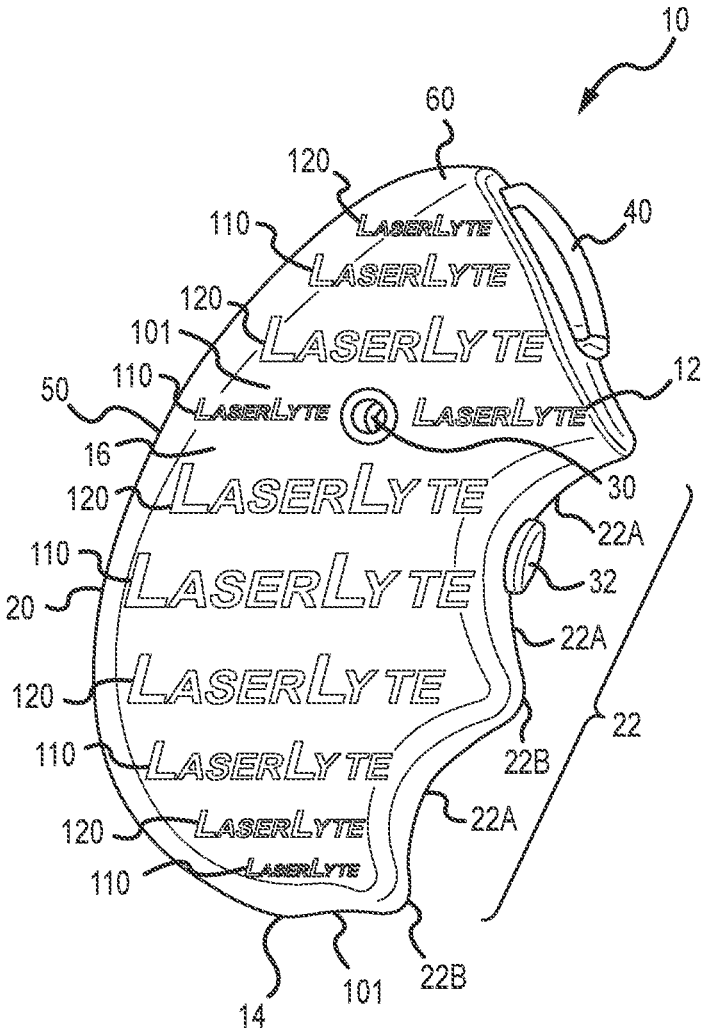
FIG. 1 is a side view of a grip according to aspects of the invention.
Figure 15:
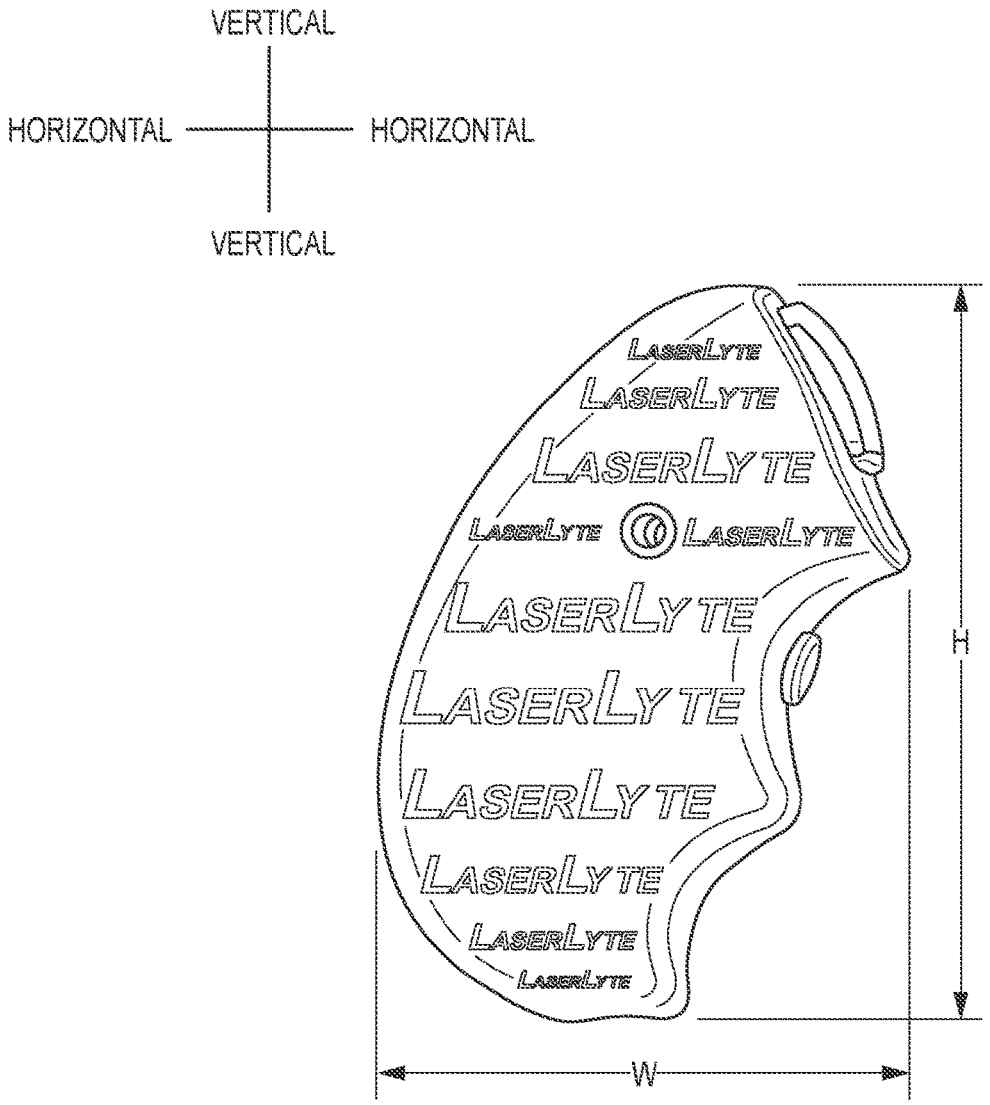
FIG. 15 shows the same side view of the grip as FIG. 1, labeling the height and width, and showing the vertical and horizontal orientations.

FIG. 1 shows a grip 10 according to aspects of the invention. A grip according to the invention has portions that enable a user to hold the grip more effectively. Grip 10 may be made of any suitable material, such as plastic or rubber, and may be compressible. For example, it may be compressible if a force of 2-5 lbs. is applied to it. Grip 10 may be made in any suitable fashion, such as by injection molding or vacuum forming. Grip 10 has a base surface 101 and, in the embodiments shown, has raised portions 110 that extend outward from the base surface 101 and lowered portions 120 that are lower than the base surface 101. Grip 10 has a width W and a height H (shown in FIG. 15). As used herein, horizontal, or horizontally, oriented means oriented generally along the horizontal line of FIG. 15, and vertical, or vertically oriented, means oriented generally along the vertical line of FIG. 15.

The raised portions 110 can be 0.005" to 0.030", or any suitable distance, above the base surface 101. Moreover, different raised portions 110 can be raised at different amounts above base surface 101 than other of raised portions 110, and/or different raised components 110A of raised portions 110 can be raised at different amounts above base surface 101. As shown in this example, each occurrence of the term "Laserlyte" that is raised above the base surface 101 is referred to as a "raised portion." In this example, each separate letter in a raised portion 110 is referred to as a raised component 110A, and each section of a letter, such as the generally vertical section and three generally horizontal sections of the letter "E" are referred to herein as "sections," or "raised sections."

Raised portions 110 can be oriented in any suitable manner on the grip, such as vertically oriented, or up to 45° of being vertically oriented, horizontally oriented, or up to 45° of being horizontally oriented, or curved. Raised portions 110 may also have a variety of orientations that could include vertical, horizontal, angled, and curved. The raised portions 110 may include one or more raised components 110A, which can be shaped as one or more letters, numbers, or designs. Raised components 110A may be of any suitable shape and include vertically-oriented, horizontally-oriented, angled curved, or other raised sections.

The orientation and configuration of the raised portions 110 may alternate from one portion 110 to another portion 110, or from one raised component 110A to another raised component 110A within a raised portion 110. As shown, the raised portions 110 are arranged horizontally on one or both sides 16, 18 of the grip 10. The raised portions 110 may extend along 50-100%, or more than 50%, or more than 60%, or more than 70%, or more than 80%, or about 90% of the width of each side 16 and 18 of grip 10. Each raised portion may have any appropriate height (as measured along the vertical axis), such as 1/32" to 1/2". The individual outwardly-extending ribs of each raised section may have a thickness of 0.005" to 0.030". The raised portions may not be present on the front grip portion 22, the back 50, or the bottom 14, of grip 10.

The raised portions 110 may also alternate with lowered portions 120, and as shown there is a horizontally-oriented row of raised portions 110 that alternate with horizontally-oriented lowered portions 120 on side 16 and side 18 of grip 10.

The lowered portions 120 can be 0.005" to 0.030", or any suitable distance, lower than the base surface 101. Moreover, different lowered portions 120 can be at lower positions relative base surface 101 than other of lowered portions 120, and/or different lowered components 120A of lowered portions 120 can be at lower positions relative base surface 101. As shown in this example, each occurrence of the term "Laserlyte" that is positioned lower than base surface 101 is referred to as a "lowered portion." In this example, each separate letter in a lowered portion 120 is referred to as a lowered component 120A, and each section of a letter, such as the generally vertical section and three generally horizontal sections of the letter "E" are referred to herein as "sections," or "lowered sections."

Lowered portions 120 can be oriented in any suitable manner on the grip, such as vertically oriented, or up to 45° of being vertically oriented, horizontally oriented, or up to 45° of being horizontally oriented, or curved. Lowered portions 120 may also have a variety of orientations that could include vertical, horizontal, angled, and curved. The lowered portions 120 may include one or more lowered components 120A, which can be shaped as one or more letters, numbers, or designs. Lowered components 120A may be of any suitable shape and include vertically-oriented, horizontally-oriented, angled curved, or other lowered sections.

The orientation and configuration of the lowered portions 120 may alternate from one portion 120 to another portion 120, or from one lowered component 120A to another lowered component 120A within a lowered portion 120. As shown, the lowered portions 120 are arranged horizontally on one or both sides 16, 18 of the grip 10. The lowered portions 120 may extend along 50-100%, or more than 50%, or more than 60%, or more than 70%, or more than 80%, or about 90% of the width of each side 16 and 18 of grip 10. Each lowered portion may have any appropriate height (as measured along the vertical axis), such as 1/32" to 1/2". The individual outwardly-extending ribs of each lowered section may have a thickness of 0.005" to 0.030". The lowered portions may not be present on the front grip portion 22, the back 50, or the bottom 14, of grip 10.

Figure 2:
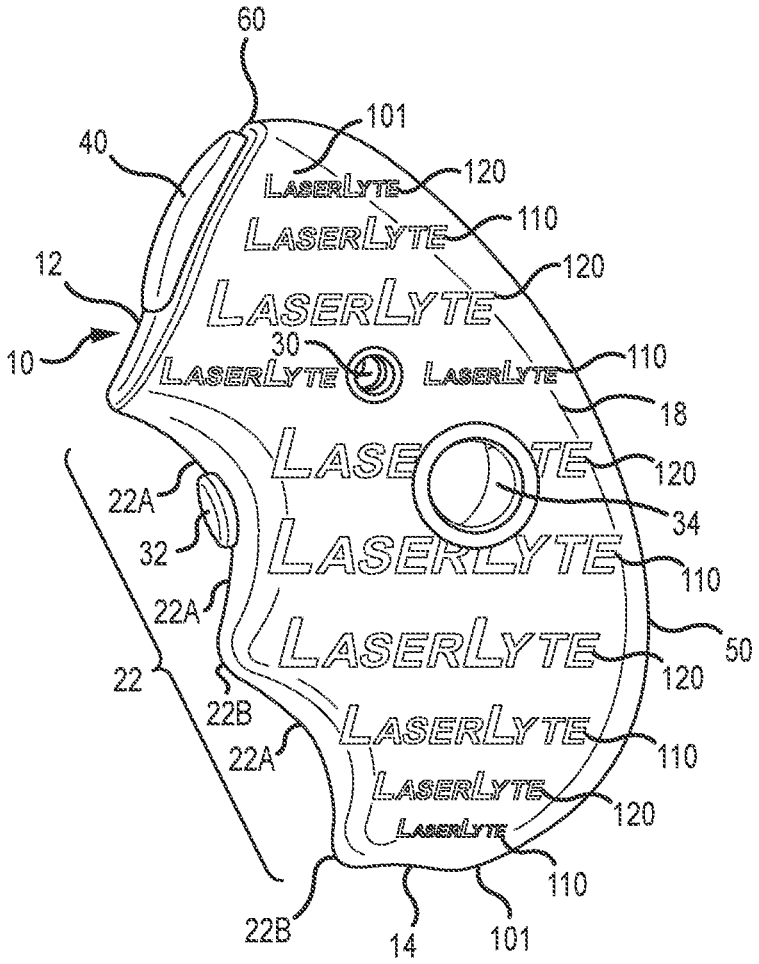
FIG. 2 is an opposite side view of the grip of FIG. 1.

FIGS. 1 and 2 show a side view of one embodiment of a grip 10. Grip 10 has two sides 16 and 18 that are pressed together around a gun handle 100, which is received in a cavity 40 of grip 10. Sides 16 and 18 are then held in place on handle 100 by a fastener (not shown) that is passed through opening 30. Structure 32 is a button to activate a laser inside of this particular grip. Structure 34, in this embodiment, is a removable cap to change the batteries that power the laser. The present grip, however, need not have a laser or any device inside of it, and need not have button 32 or cap 34.

Structure 40 is a cavity inside of grip 10, and that has and opening at top 60, for receiving gun handle 100. Grip 10 has a grip portion 22 is generally shaped to be comfortably gripped by a hand that comprise depressions 22A and raised sections 22B. Grip 10 also has a bottom section 14, a back 50 (which as shown is smooth), a top 60, and a support section 12.

Figure 3:
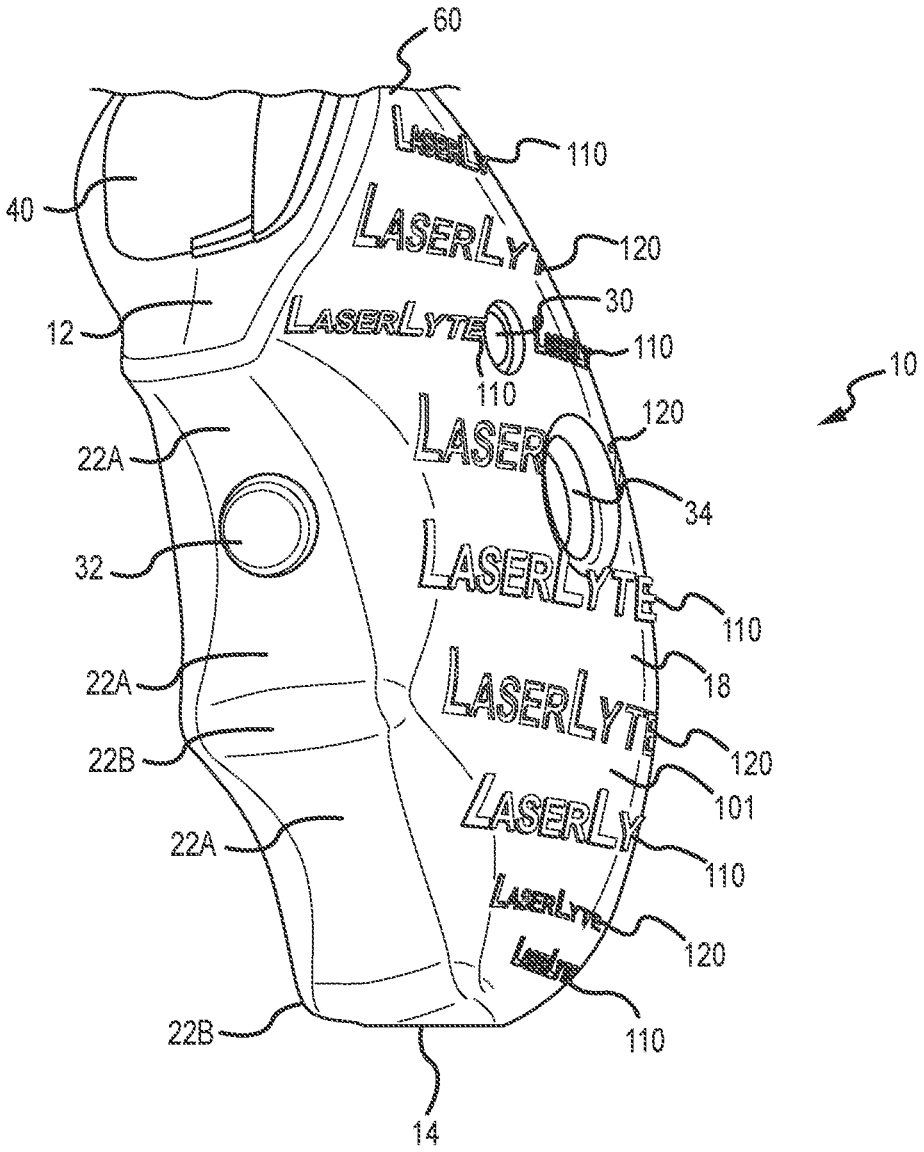
FIG. 3 is a front, perspective view of the grip of FIG. 1.
Figure 4:
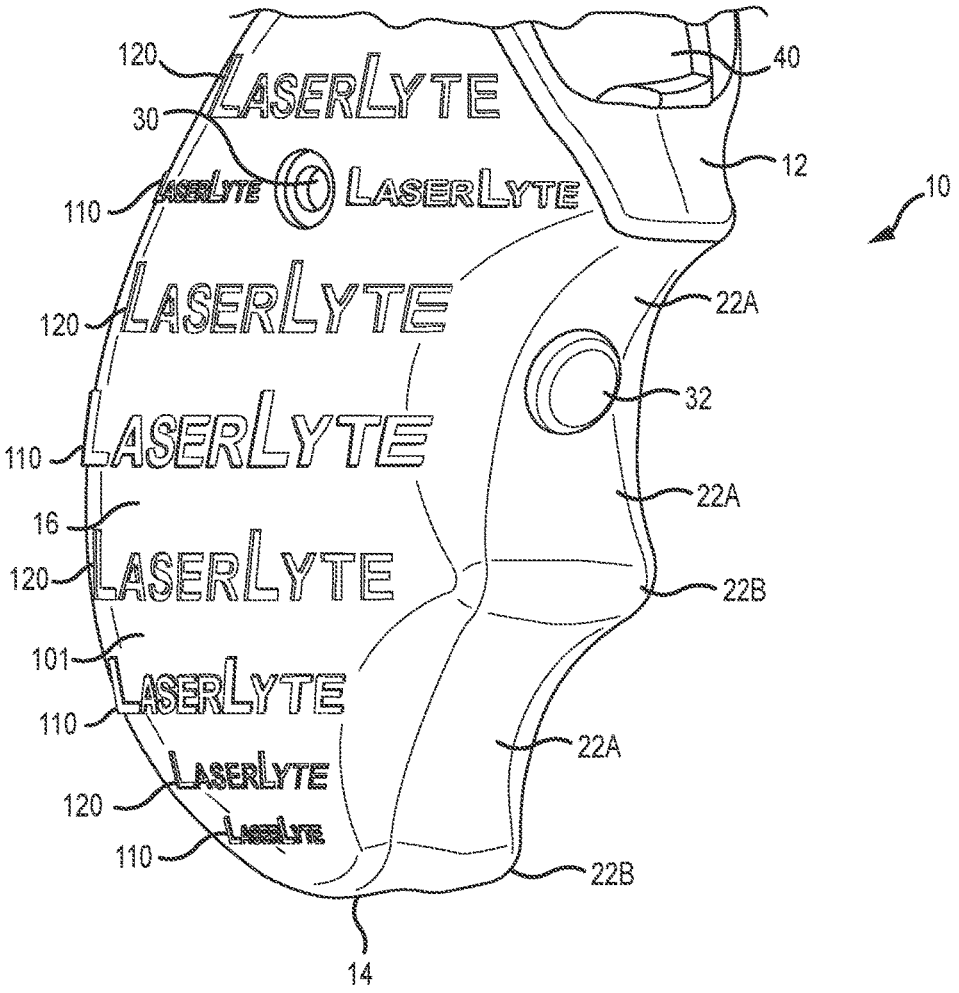
FIG. 4 is a front, perspective view of the grip of FIG. 1.

FIGS. 3-4 are front, perspective view of the grip 10 shown in FIGS. 1-2. As shown, the raised portions 110 and lowered portions 120 spell LASERLYTE in upper case and lower case letters. The height and width of the raised portions 110 and lowered portions 120 are smaller near the top 60 of grip 10, and near the bottom 14 of grip 10, than they are in the mid-section of grip 10. Portions 110 and/or 120 may however, be the same size at all locations on the grip, or may vary in size moving horizontally, for example from grip area 22 to rear 50. Each individual component 110A and 120A in this example becomes correspondingly larger or smaller in proportion to the portion 110 or 120 with which it is associated. In this embodiment, each individual letter would be a component 110A (if the letter is raised) or 120A (if the letter is lowered).

Figure 5:
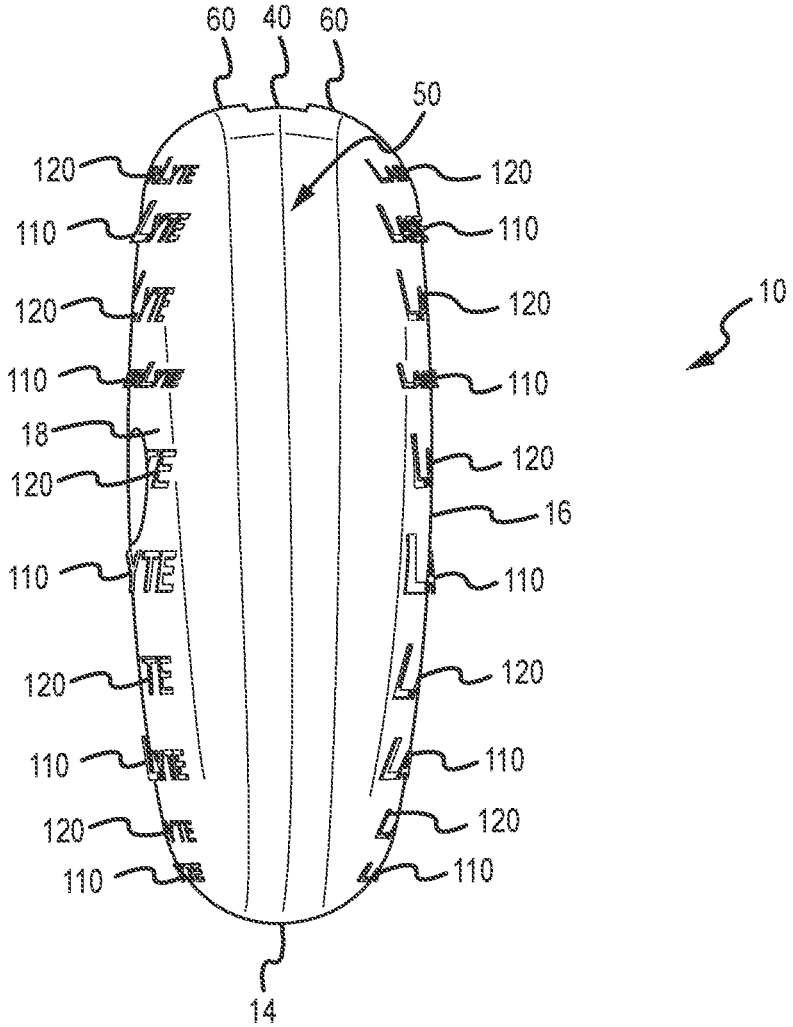
FIG. 5 is a rear view of the grip of FIG. 1.
Figure 6:
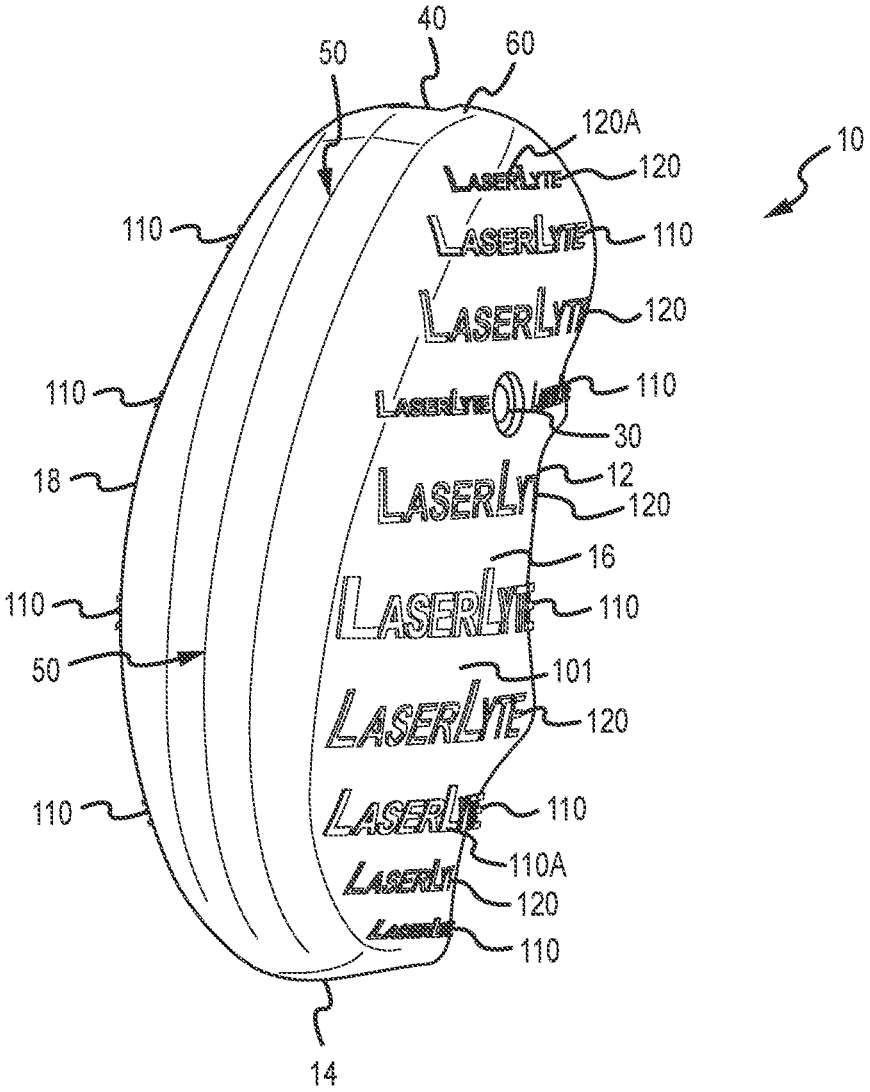
FIG. 6 is a rear, perspective view of the grip of FIG. 1.
Figure 7:
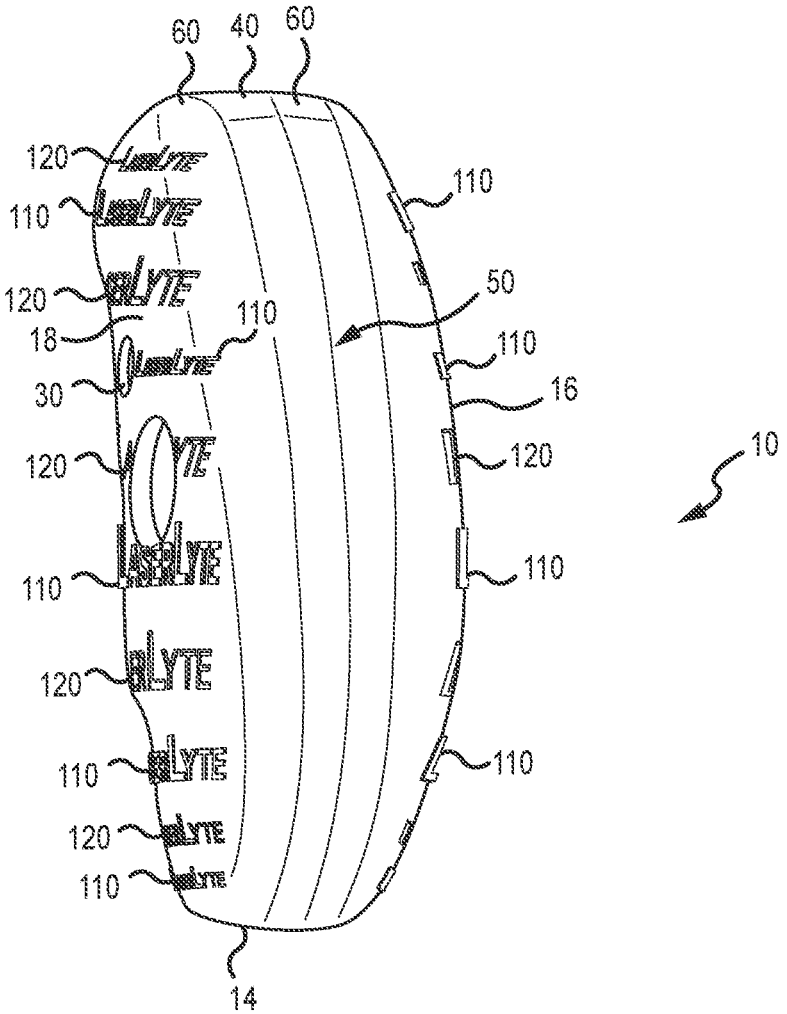
FIG. 7 is a rear, perspective view of the grip of FIG. 1.

FIG. 5 is a rear view, and FIGS. 6-7 are rear, perspective views of a gun grip according to aspects of the invention.

Figure 8:
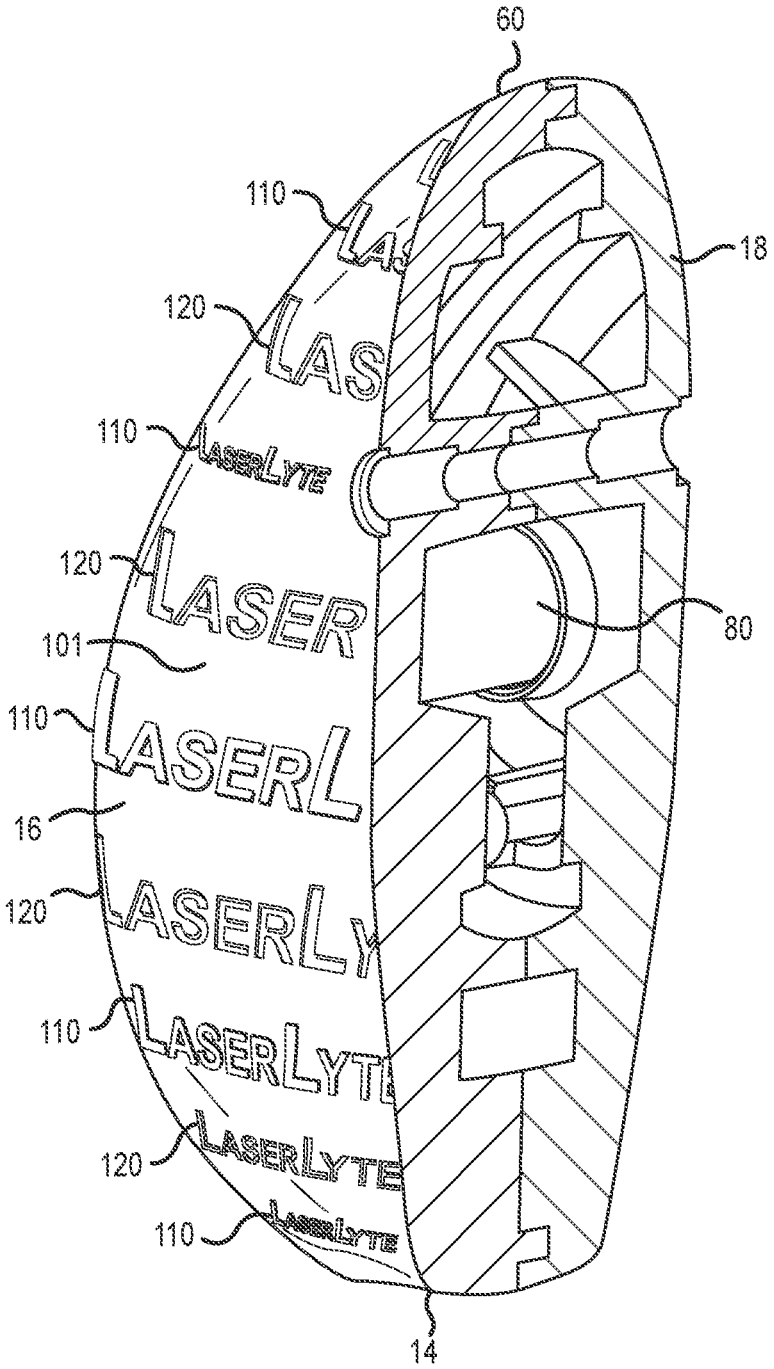
FIG. 8 is a cross-sectional, front, perspective view of the grip of FIG. 1.
Figure 9:
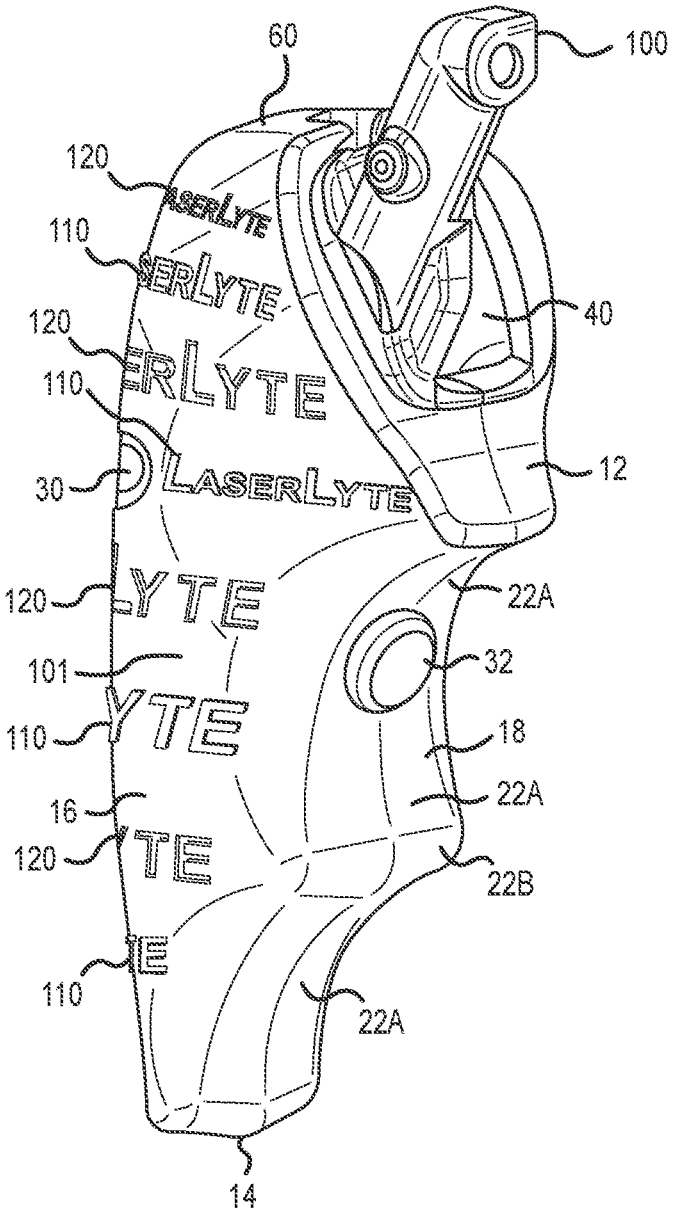
FIG. 9 is a front, perspective view of the grip of FIG. 1 showing the gun handle.

FIG. 8 is a cross-section, front perspective view of a grip 10 according to aspects of the invention, in which a protrusion 80 of the gun handle 100 is shown, wherein the protrusion provides support for grip 10. FIG. 9 is a cross-sectional, front perspective view of a grip 10 that shows the gun handle 100 inside of cavity 40 and side 16 and 18 secured to handle 100 by a fastener (not shown) passed through opening 30.

Figure 10:
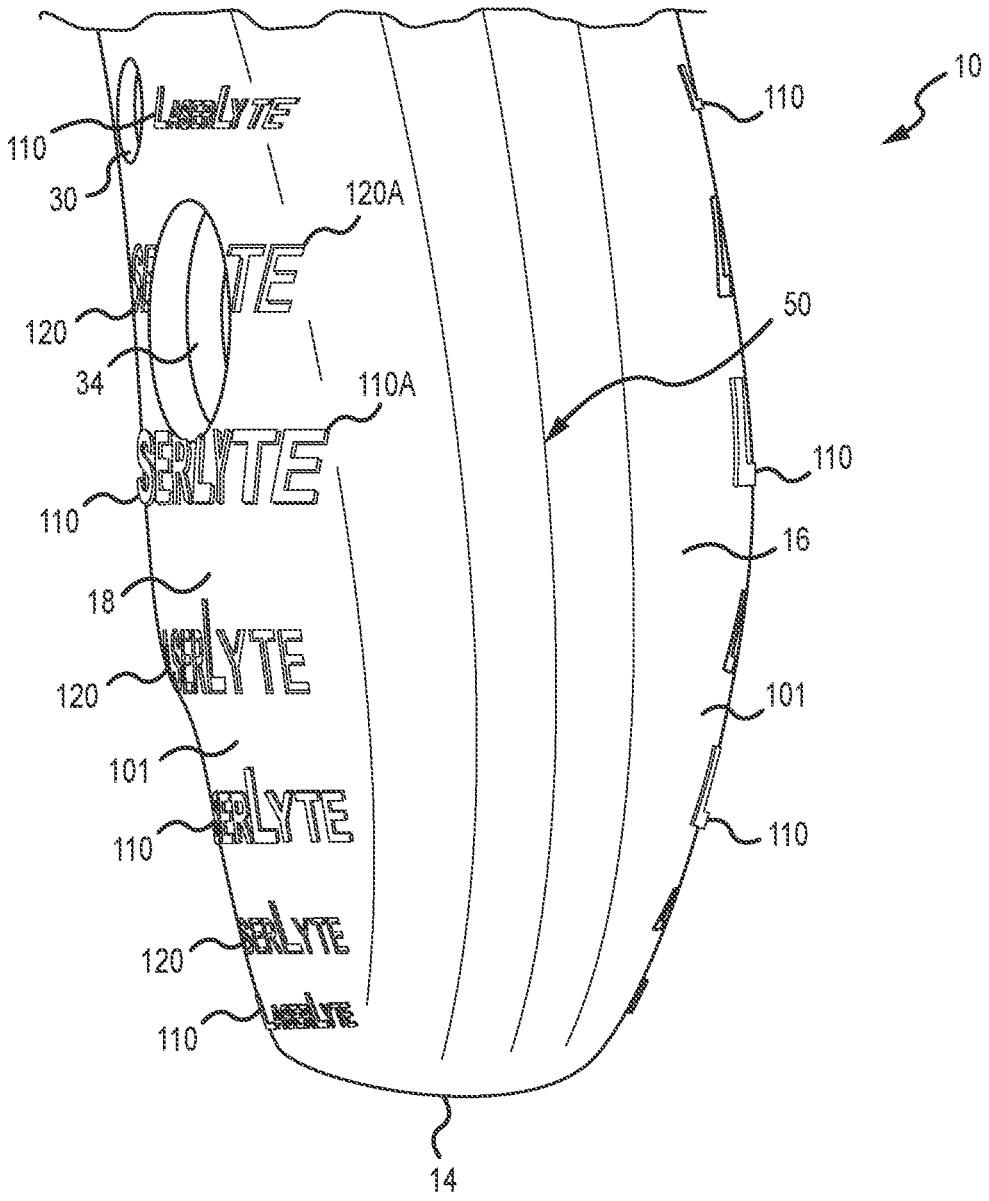
FIG. 10 is a partial, rear, perspective view of the grip of FIG. 1.
Figure 11:
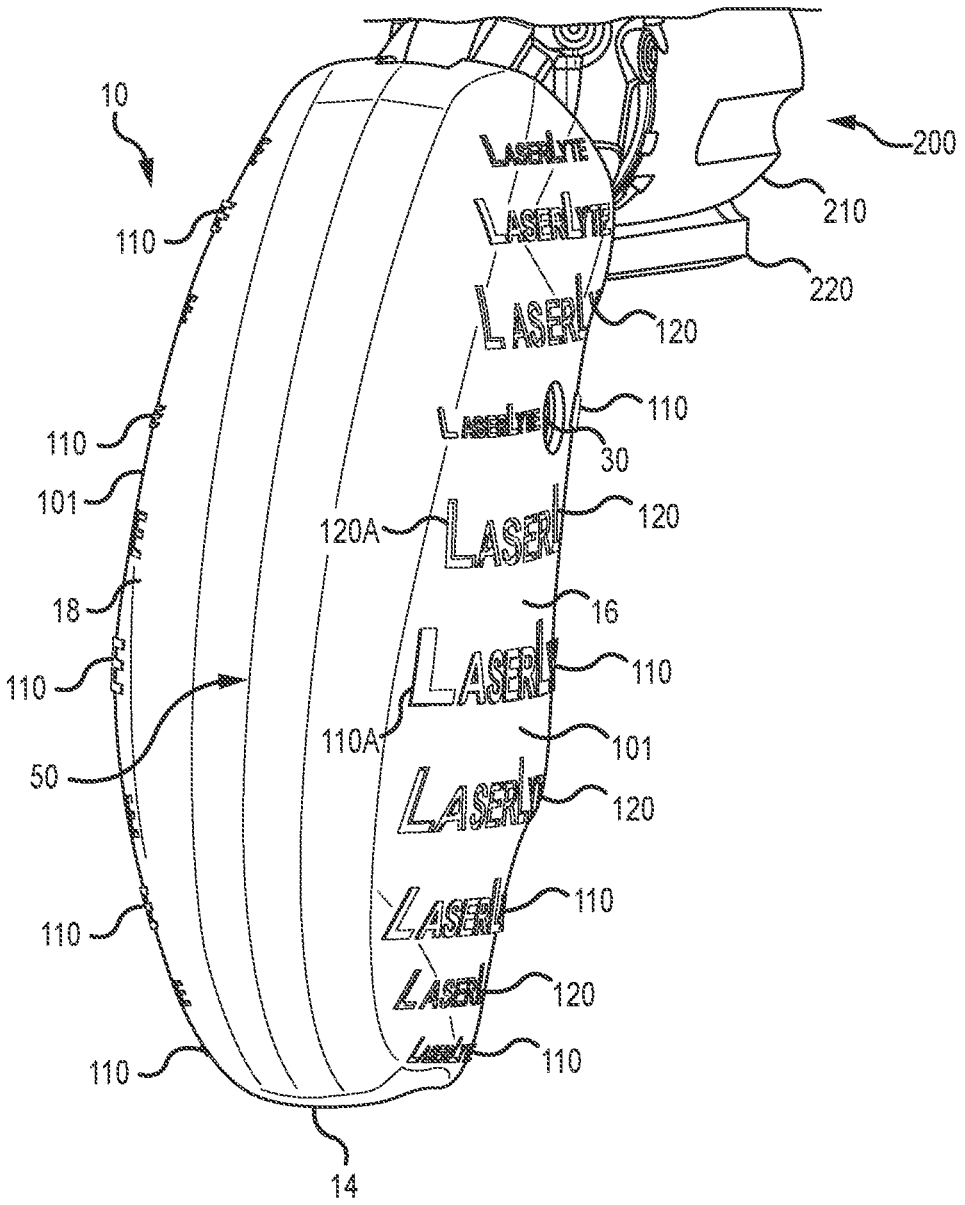
FIG. 11 is a rear, perspective view of the grip of FIG. 1 attached to a gun.
Figure 12:
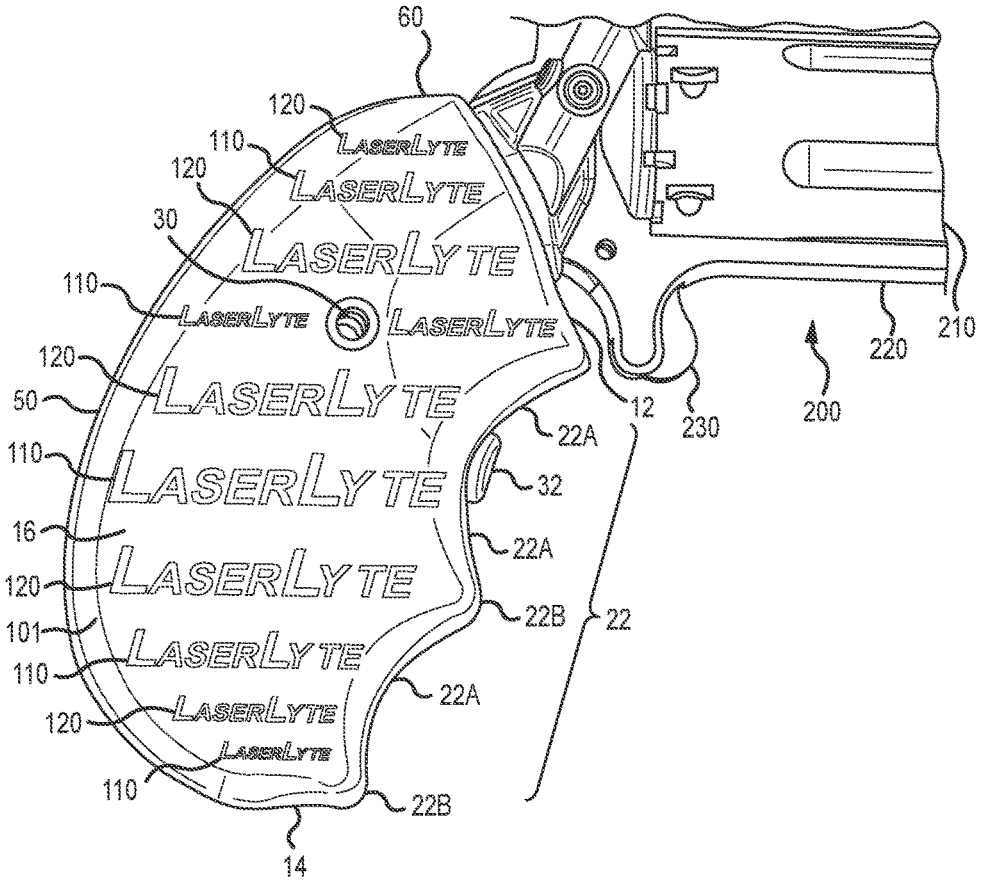
FIG. 12 is a side view of the grip and gun of FIG. 11.
Figure 13:
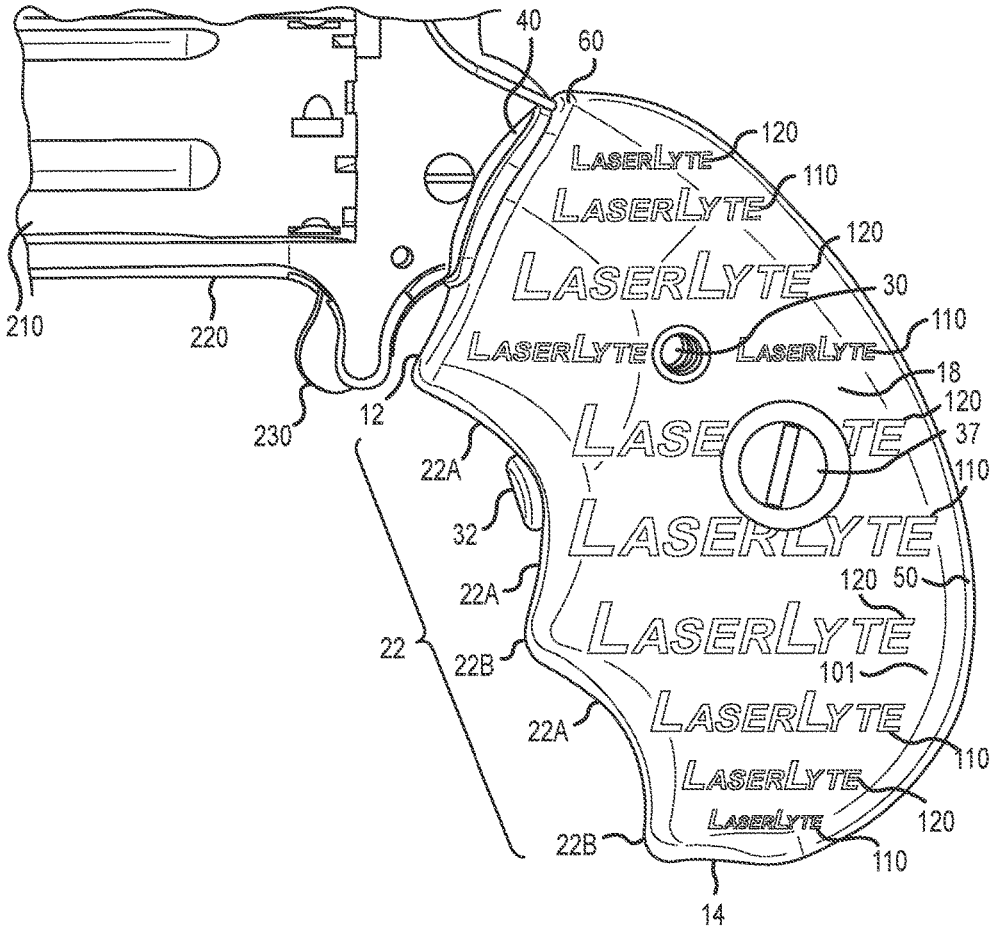
FIG. 13 is an opposite side view of the grip and gun of FIGS. 11 and 12.
Figure 14:
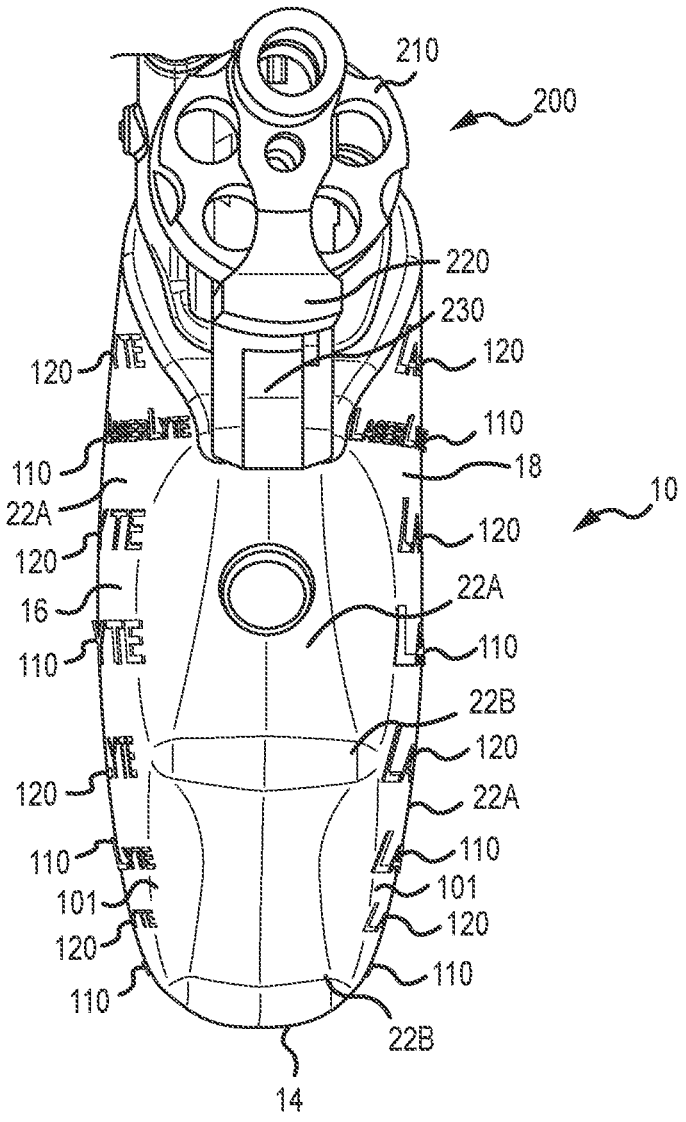
FIG. 14 is a front view of the grip and gun of FIGS. 11-13.

FIG. 10 is a close-up, partial view of grip 10. FIGS. 11-14 show grip 10 on a revolver 200. A grip according to the invention, however, may be used on any suitable firearm. Revolver 200 has a cylinder 210, which has slots (not shown) configured for retaining bullets before they are fired, and then retaining the bullet shells after the bullet is fired. Revolver 200 also had a lower rail 210 and a trigger 230.

Some specific, non-limiting examples of the invention are as follows:

Example 1

A gun grip configured to be applied to a gun, the gun grip having: (a) A first side and a second side; (b) a base surface; and (c) raised portions that extend above the base surface.

Example 2

The gun grip of example 1 that further includes lowered portions that are lower than the base surface.

Example 3

The gun grip of example 1 or 2, wherein the raised portions are between 0.005" and 0.050" above the base surface.

Example 4

The gun grip of example 2 wherein the lowered portions are between 0.005" and 0.050" below the base surface.

Example 5

The gun grip of example 3 wherein the lowered portions are between 0.005" and 0.050" below the base surface.

Example 6

The gun grip of example 2 wherein gun grip has a height, and the raised portions and lowered portions alternate along the height of the first side and of the second side.

Example 7

The gun grip of example 6 wherein the gun grip has a width and the raised portions and lowered portions extend the same distance across the width of the first side and the second side.

Example 8

The gun grip of example 1 wherein the raised portions and lowered portions have the same configuration.

Example 9

The gun grip of example 1 wherein each of the raised portions comprises a plurality of raised components.

Example 10

The gun grip of example 2 wherein each of the lowered portions comprises a plurality of lowered components.

Example 11

The gun grip of example 2 wherein each of the raised portions comprises a plurality of raised components and each of lowered portions comprises a plurality of lowered components.

Example 12

The gun grip of example 2 that has a back and there are no raised portions or lowered portions on the back.

Example 13

The gun grip of example 2 that has a front, gripping section and there are no raised portions or lowered portions on the front, gripping section.

Example 14

The gun grip of example 1 wherein each raised portion includes a plurality of raised components shaped as letters.

Example 15

The gun grip of example 2 wherein each lowered portion includes plurality of lowered components shaped as letters.

Example 16

The gun grip of example 2 wherein each raised portion includes a plurality of raised components shaped as letters and each lowered portion includes a plurality of lowered components shaped as letters.

Example 17

The gun grip of example 1 that is attached to a gun.

Example 18

The gun grip of example 15 wherein each raised portion and each lowered portion comprises at least nine components.

Example 19

The gun grip of example 1 wherein each of the sides includes an opening for receiving a fastener therethrough in order to attach the gun grip to a handle of the gun.

Example 20

The gun grip of example 17 that is attached to a revolver.

Example 21

The gun grip of example 1 wherein each of the raised portions include sections that are horizontally oriented.

Example 22

The gun grip of example 1 wherein each of the raised portions include sections that are angled.

Example 23

The gun grip of example 1 wherein each of the raised portions include sections that are curved.

Example 24

The gun grip of example 1 wherein the raised portions extend along at least 50%, or at least 60%, or at least 70%, or at least 80% of the width of the first side and the width of the second side.

Example 25

The gun grip of example 1 wherein each of the lowered portions include sections that are horizontally oriented.

Example 26

The gun grip of example 1 wherein each of the lowered portions include sections that are angled.

Example 27

The gun grip of example 2 wherein the lowered portions extend along at least 50%, or at least 60%, or at least 70%, or at least 80% of the width of the first side and the width of the second side.

Example 28

The gun grip of example 2 wherein there is a distance of 1/16" to 1/4" between each raised portion and each lowered portion.

Example 29

The gun grip of example 1 wherein the raised portions constitute 5% or more of the surface of the grip.

Example 30

The gun grip of example 1 wherein the raised portions constitute 10% or more of the surface of the grip.

Example 31

The gun grip of example 2 wherein the lowered portions comprise 5% or more of the surface of the gun grip.

Example 32

The gun grip of example 2 wherein the lowered portions comprise 10% or more of the surface of the gun grip.

Example 33

The gun grip of example 1 wherein each raised portion is between 1/32" and 1/2" in height.

Example 34

The gun grip of example 2 wherein each lowered portion is between 1/16" and 1/2" in height.

Example 35

The gun grip of example 1 wherein each raised portion has raised sections, and each raised section is between 0.005" and 0.030" thick.

Example 36

The gun grip of example 2 wherein each lowered portion has lowered sections, and each lowered section is between 0.005" and 0.030" thick.

Example 37

The gun grip of example 1 that is compressible when gripped with a force of 2 pounds or more.

Example 38

The gun grip of example 1 that is compressible when gripped with a force of 5 pounds or more.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A gun grip configured to be applied to a pistol-style handle, the gun grip having:

(a) a first side that is a one-piece, plastic part, the first side having a height and a width, and a second side that is a one-piece, plastic part, the second side having a height and a width;

(b) a base surface;

(c) raised portions on the first side and on the second side, wherein the raised portions extend above the base surface;

(d) lowered portions on the first side and on the second side, wherein the lowered portions are lower than the base surface;

(e) a back that has no raised portions or lowered portions and a front that has no raised portions or lowered portions;

(f) the raised portions and lowered portions alternate along the height of the first side and along the height of the second side, wherein each of the lowered portions includes a plurality of lowered components shaped as letters.

2. The gun grip of claim 1, wherein the raised portions are between 0.005" and 0.050" above the base surface.

3. The gun grip of claim 2, wherein the lowered portions are between 0.005" and 0.050" below the base surface.

4. The gun grip of claim 3, wherein the raised portions and lowered portions extend an equal distance across the height of the first side and the height of the second side.

5. The gun grip of claim 1, wherein the lowered portions are between 0.005" and 0.050" below the base surface.

6. The gun grip of claim 1, wherein the raised portions and lowered portions extend an equal distance across the width of the first side and the width of the second side.

7. The gun grip of claim 6, wherein the raised portions and lowered portions extend an equal distance across the height of the first side and the height of the second side.

8. The gun grip of claim 1, wherein the raised portions have a first configuration and the lowered portions have a second configuration, wherein the first configuration and second configuration are the same.

9. The gun grip of claim 1, wherein each of the raised portions comprises a plurality of raised components.

10. The gun grip of claim 1, wherein each of the lowered portions comprises a plurality of lowered components.

11. The gun grip of claim 1, wherein each of the raised portions comprises a plurality of raised components and each of lowered portions comprises a plurality of lowered components.

12. The gun grip of claim 1, wherein each of the raised portions includes a plurality of raised components shaped as letters.

13. The gun grip of claim 1, wherein each of the raised portions includes a plurality of raised components shaped as letters and each of the lowered portions includes a plurality of lowered components shaped as letters.

14. The gun grip of claim 1 that is attached to one of the group consisting of a pistol, a machine pistol, and a rifle.

15. The gun grip of claim 1, wherein each of the lowered portions comprises at least nine components.

16. The gun grip of claim 1, wherein the first side includes an opening for receiving a fastener therethrough in order to attach the first side to a handle of the gun, and the second side includes an opening for receiving a fastener therethrough in order to attach the second side to the handle of the gun.

17. The gun grip of claim 1 that is attached to a gun selected from the group consisting of a revolver and an automatic pistol.

18. The gun grip of claim 1, wherein each of the raised portions include sections that are horizontally oriented.

19. The gun grip of claim 1, wherein each of the raised portions include sections that are angled.

20. The gun grip of claim 1, wherein each of the raised portions include sections that are curved.

21. The gun grip of claim 1, wherein the raised portions extend along at least 50%, or at least 60%, or at least 70%, or at least 80% of the width of the first side and the width of the second side.

22. The gun grip of claim 1, wherein each of the lowered portions include sections that are horizontally oriented.

23. The gun grip of claim 1, wherein each of the lowered portions include sections that are angled.

24. The gun grip of claim 1, wherein the lowered portions extend along at least 50%, or at least 60%, or at least 70%, or at least 80% of the width of the first side and the width of the second side.

25. The gun grip of claim 1, wherein there is a distance of 1/16" to 1/4" between each of the raised portions and each of the lowered portions.

26. The gun grip of claim 1, wherein the gun grip has a surface area, and the raised portions constitute 5% or more of the surface area.

27. The gun grip of claim 1, wherein the gun grip has a surface area and the raised portions constitute 10% or more of the surface area.

28. The gun grip of claim 1, wherein the gun grip has a surface area and the lowered portions comprise 5% or more of the surface area.

29. The gun grip of claim 1, wherein the gun grip has a surface area and the lowered portions comprise 10% or more of the surface area.

30. The gun grip of claim 1, wherein each of the raised portions is between 1/32" and 1/2" in height.

31. The gun grip of claim 1, wherein each of the lowered portions is between 1/16" and 1/2" in height.

32. The gun grip of claim 1, wherein each of the raised portions has raised sections, and each raised section is between 0.005" and 0.030" thick.

33. The gun grip of claim 1, wherein each of the lowered portions has lowered sections, and each lowered section is between 0.005" and 0.030" thick.

34. The gun grip of claim 1 that is compressible when gripped with a force of 2 pounds or more.

35. The gun grip of claim 1 that is compressible when gripped with a force of 5 pounds or more.

36. The gun grip of claim 1 that has a front, gripping section that has no raised portions or lowered portions.

* * * * *